US006041675A

United States Patent [19]

Willomitzer

[11] Patent Number: 6,041,675

[45] Date of Patent: Mar. 28, 2000

[54] ADJUSTMENT MEMBER FOR AT LEAST ONE DEVICE PROVIDED WITH A ROTATION SHAFT

[75] Inventor: Manfred Willomitzer, Frankfurt/M., Germany

[73] Assignee: U.S. Philips Corporation, New York, N.Y.

[21] Appl. No.: 09/039,352

[22] Filed: Mar. 13, 1998

[30] Foreign Application Priority Data

Mar. 20, 1997 [DE] Germany ..... 197 11 615

[51] Int. Cl.[7] ..... G05G 1/14

[52] U.S. Cl. ..... 74/531

[58] Field of Search ..... 74/531, 491, 523; 188/72.6

[56] References Cited

U.S. PATENT DOCUMENTS

| | | | |
|---|---|---|---|
| 2,382,330 | 8/1945 | Pain | 74/531 |
| 2,576,959 | 12/1951 | Petersen | 74/531 |
| 4,089,393 | 5/1978 | Falk | 188/72.6 |
| 4,841,800 | 6/1989 | Deffner et al. | 74/531 |

*Primary Examiner*—David A. Bucci
*Assistant Examiner*—Colby Hansen
*Attorney, Agent, or Firm*—F. Brice Faller

[57] ABSTRACT

A lever (14) is fixed to a shaft (15) which can be connected to a rotation shaft (19) of a device such as a potentiometer. The shaft (15) is journaled in a pair of support plates (10, 11) which are rigidly connected to one another, and brake discs (23) having brake linings (22) are arranged between the lever (14) and the support plates (10, 11). Cup springs (24) provide a spring force acting transversely to the operational direction of the lever (14), so that frictional forces provided by the brake linings (22) assure a smooth and jolt free operation of the lever (14).

12 Claims, 6 Drawing Sheets

ADJUSTMENT MEMBER FOR AT LEAST ONE DEVICE PROVIDED WITH A ROTATION SHAFT

BACKGROUND OF THE INVENTION

The invention relates to an adjustment member for at least one device provided with a rotation shaft, for example to a mixing lever for operating at least one potentiometer, with at least one lever which is fixed to a shaft journaled in a frame so as to be rotatable and which is connected by means of this shaft to the rotation shaft of the device in a mechanically non-positive manner, and with friction means acting under spring force.

Video programs are usually produced by means of a mixer which makes an output video signal from several input video signals. Input video signals can be faded in, faded out, or intermixed by means of a mixer, in dependence on the artistic effect envisaged. In a manual mixing process, a mixing lever is used as the adjustment member, comprising a potentiometer whose rotation shaft is connected to a shaft of the lever in a mechanically non-positive manner. A mixer comprises a plurality of such mixing levers, the potentiometer being arranged below the control panel surface and the lever being passed through a slot in the control panel surface, so that it can be operated by the operator. Operators of studio mixers impose high requirements on the mechanical properties of such mixing levers. It must be possible to carry out mixing/fading operations with pixel accuracy.

An adjustment member of the kind described above may comprise a lever for operating only one device or alternatively, for example, two levers for operating two devices. Accordingly, a mixing lever as described here may comprise one lever for operating only one potentiometer or alternatively, for example, two levers for operating two potentiometers, in which case the levers and devices, i.e. potentiometers, are coupled so as to form a unit.

In known mixing devices, the lever has a circular portion against which a resilient element is pressed. When the lever is operated, a more or less strong, adjustable force is exerted by the resilient element., so that the lever can be operated without play and without jolts. It has been shown that the friction surface of the lever becomes uneven in the course of time, so that the lever can no longer be moved smoothly but only in steps.

SUMMARY OF THE INVENTION

The invention has for its object to provide an adjustment member, for example a mixing lever, such that it has a smooth operation and can be operated without play and jolts in a durable manner.

According to the invention, the shaft of the lever is journaled on both sides, in two support plates which are rigidly connected to one another, the friction means are arranged between the lateral surfaces of the lever and at least one of the support plates, and the spring force is active transversely to the operational direction of the lever.

Such a two-sided journaling of the lever asssures an absolutely stable position of the lever. In contrast to known constructions, where the lever is journaled in a support on one side and in a potentiometer on the other side, the latter in its turn being fastened to the support, transverse movements of the lever in the construction according to the invention cannot have any undesirable effect on the device to be operated, for example on a potentiometer. The friction means are present between the lever and at least one of the support plates of the frame and are pressed against one of the or both support plates of the frame or against one of the or both sides of the lever by spring pressure. A desired friction between the lever on the one hand and the support plates of the frame on the other hand may thus be achieved in a simple manner, so that the lever can be smoothly operated without jolts.

In an embodiment of the invention, the shaft of the lever supports at at least one side a brake disc provided with a brake lining, which disc is rotationally fixedly connected to the lever and is pressed with its brake lining against the adjoining support plate by resilient means. Such a brake disc can be easily manufactured and mounted, while in a preferred embodiment of the invention such a brake disc with resilient means is arranged on each side of the lever. Cup springs are preferably used as the resilient means, which can be provided on the shaft of the lever in a simple manner. One or several cup springs may be utilized, as desired. The respective required friction between the lever and the flanking support plates may be coarsely adjusted by means of the number of the cup springs, while in a further embodiment of the invention spacer discs for fine adjustment may be provided between the cup springs on the one hand and the adjoining surfaces of the lever on the other hand.

In the construction described above, it is assumed that the brake lining of the brake disc applies itself to the inside of the relevant support plate. It should be assured in that case that the brake disc is fixedly coupled to the lever. It is alternatively possible, however, for the brake lining to act on the lateral surfaces of the lever. Accordingly, the shaft of the lever may include a brake disc provided with a brake lining at at least one side, which disc is rotationally fixedly connected to the adjoining support plate and is pressed with its brake lining against the lever by resilient means. In this embodiment, therefore, the brake disc is fixedly connected to the relevant adjoining support plate, in contrast to the former construction, so that an adjustable friction force is provided between the lever on the one hand and the friction surfaces of the brake discs applied against the lever on the other hand. In this construction, again, cup springs may be preferably used, while also spacer discs for fine adjustment may be inserted between the cup springs on the one hand and the adjoining walls of the support plates on the other hand.

In an embodiment of the invention relating to the former construction, the brake discs and the lever are fixedly interconnected by means of a pin which is fixedly mounted in the lever and which enters a recess or bore which is situated radially on the outside of the brake disc. Any tolerances between the brake disc and the journaling point on the rotation shaft will have a lesser effect and the lever can be operated more smoothly in proportion as this pin engages the brake disc radially farther to the outside.

In the second construction, the fixed connection between the brake discs and the support plates are achieved in a further embodiment of the invention in that the brake disc and the adjoining support plate are rotationally fixedly interconnected by means of a catch which engages a recess of the brake disc.

In a further embodiment of the invention, two levers provided on their outsides with a brake disc and associated resilient means are rotatably coupled to one another at their free inner sides by means of a centering piece, and a brake lining is provided between the mutually facing flat sides of the levers. Such a construction renders possible a joint operation or an individual operation of the two levers in a simple manner.

A further embodiment of the invention is characterized in that two levers each provided on the outside with a brake disc and associated resilient means are journaled in a rigid central frame portion at their free lever sides, with an interposed additional brake lining, which central frame portion is rigidly connected to the support plates. Such a mixing lever arrangement with two levers renders possible a mechanical uncoupling of the two levers which can be operated independently of one another and which nevertheless form an integral unit.

DETAILED DESCRIPTION OF THE PREFERRED EMBODIMENTS

Figure 1A:
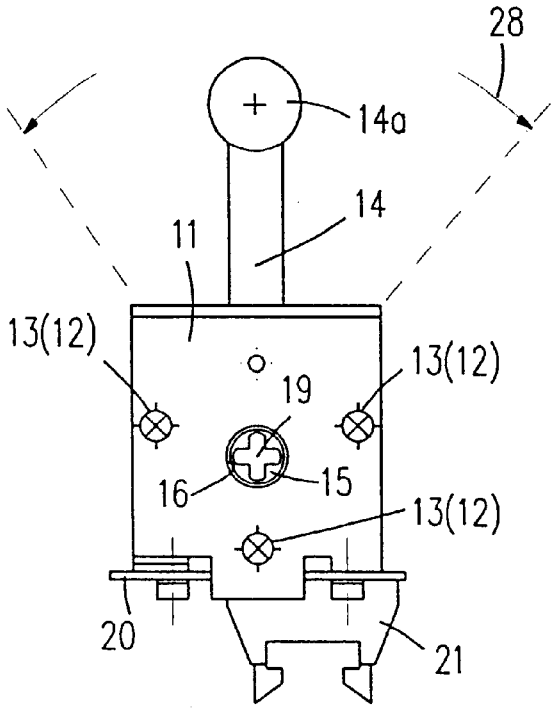
FIGS. 1A to 1C show a mixing lever with brake discs and a lever for operating a potentiometer in three elevations.
Figure 1B:
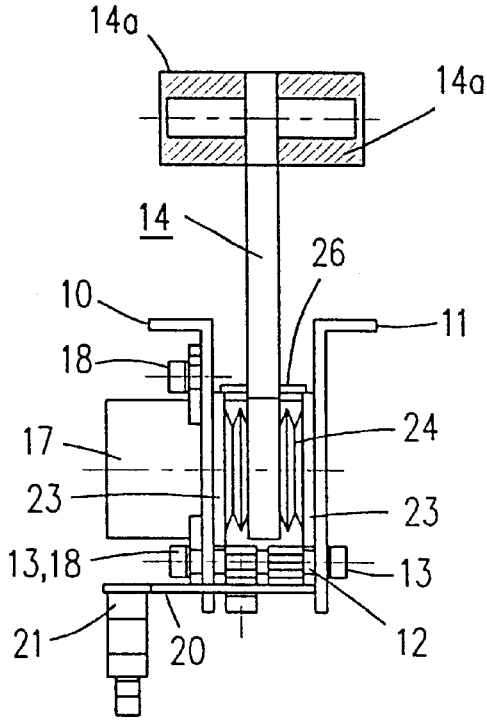
Figure 1C:
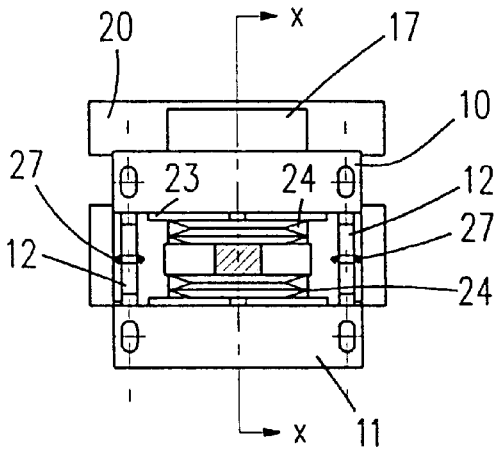

The mixing lever shown in FIGS. 1A to 1C comprises two support plates 10 and 11 which are interconnected so as to form a rigid frame by means of three nuts 12 and screws 13. A lever 14 is shaft 15 fixed to which is journaled in holes 16 of the support plates 10, 11 and serves for causing a potentiometer 17 to rotate, which potentiometer is fastened to the support plate 10 by means of screws 18. The rotation shaft 19 of the potentiometer is mechanically non-positively coupled to the shaft 15 of the lever 14. Reference numeral 20 denotes a printed circuit board and 21 denotes a contact block.

Figure 2A:
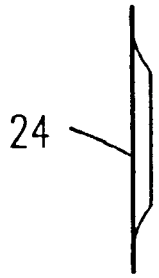
FIGS. 2A and 2B are two elevations of a cup spring.
Figure 2B:
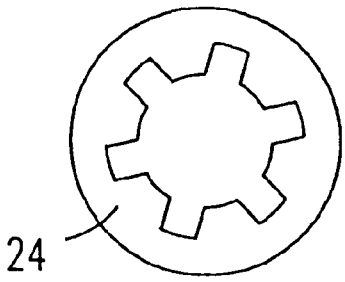
Figure 3A:
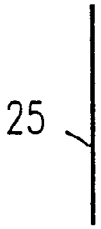
FIGS. 3A and 3B are two elevations of a spacer disc.
Figure 3B:
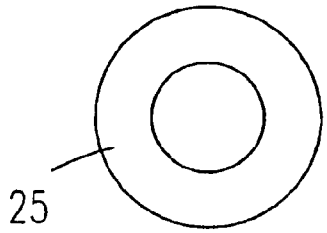
Figure 4A:
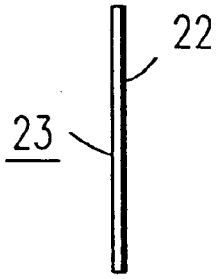
FIGS. 4A and 4B are two elevations of a brake disc.
Figure 4B:
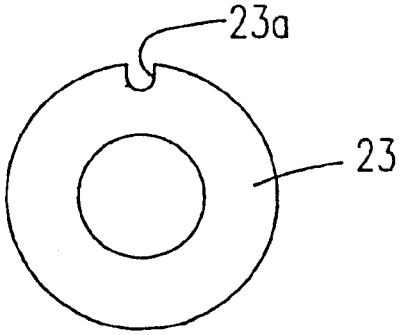

The shaft 15 carries on both sides of the lever 14 a brake disc 23 provided with a brake lining 22, each disc being pressed with its brake lining 22 against the adjoining support plate 10, 11 by means of respective cup springs 24 arranged on the shaft. Spacer discs 25 (see also FIG. 2A) are accommodated between the cup springs 24 and the lever 14 for fine adjustment and for protection of the lever. A catch pin 26 fixedly connected to the lever 14 enters recesses 23a of the brake discs 23 and accordingly achieves a fixed rotational connection between the lever 14 and the brake discs 23. A very exact adjustment of the lever 14 is thus rendered possible in dependence of the value of the spring pressure of the cup springs 24, so that the lever can be operated very smoothly and free from jolts by means of its handle 14*a*. The circular path of the lever 14 is limited by buffers 27 which are arranged on the two nuts 12 which lie uppermost in FIG. 1A. The rotational range is indicated with the angle 28 in FIG. 1A.

Figure 5:
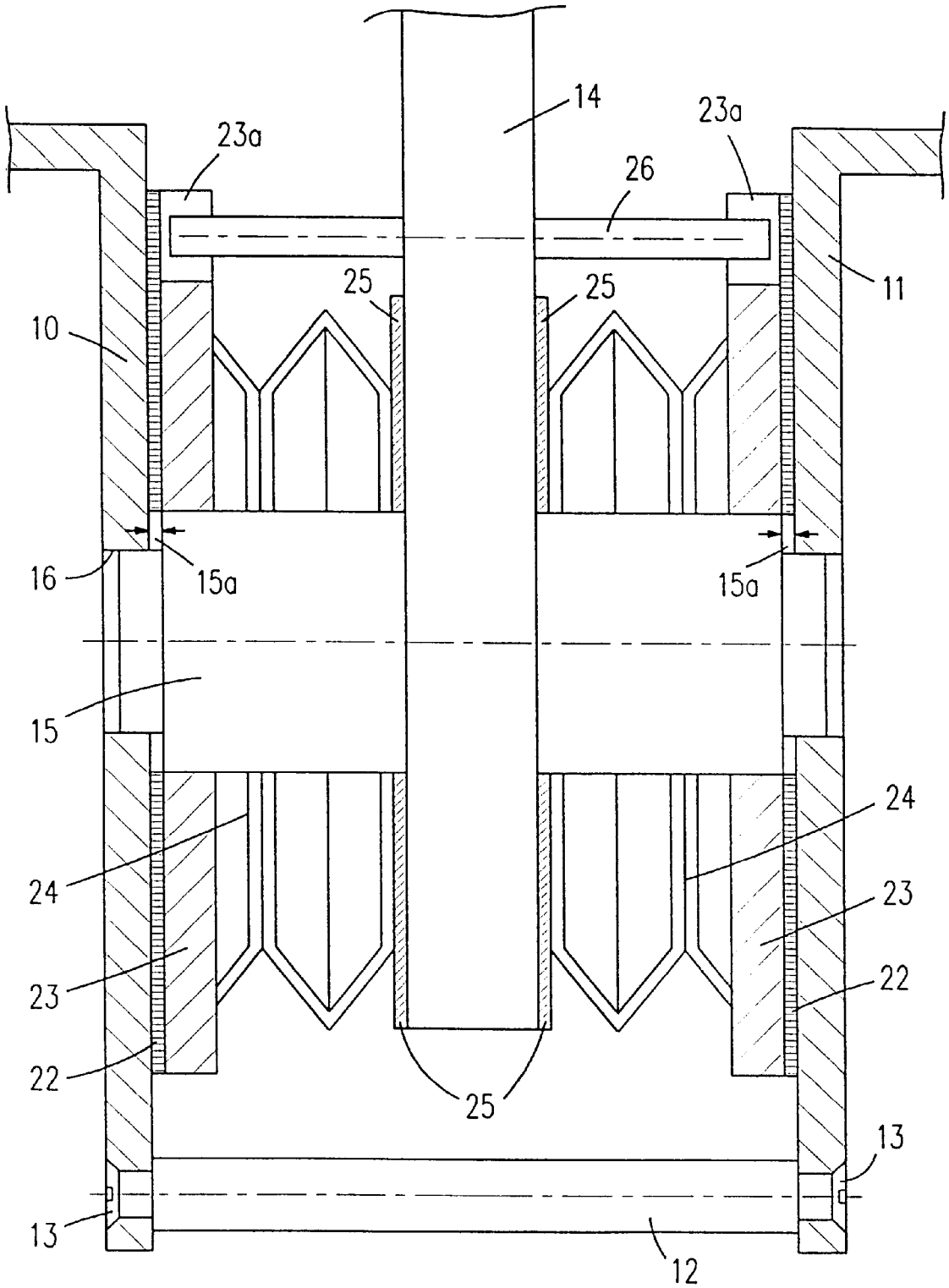
FIG. 5 is a cross-sectional view taken on the line X—X in FIG. 1C, diagrammatic and on an enlarged scale, with non-essential parts being left out.

FIG. 5 shows the construction described above on an enlarged scale, where it is clearly apparent that the brake discs 23 arranged on either side of the lever 14 are pressed with their brake linings 22 against the inner sides of the support plates 10, 11 by the cup springs 24.

A clearance 15*a* between the shaft 15 and the support plate 10, 11 safeguards a cantilevered journaling.

Figure 6:
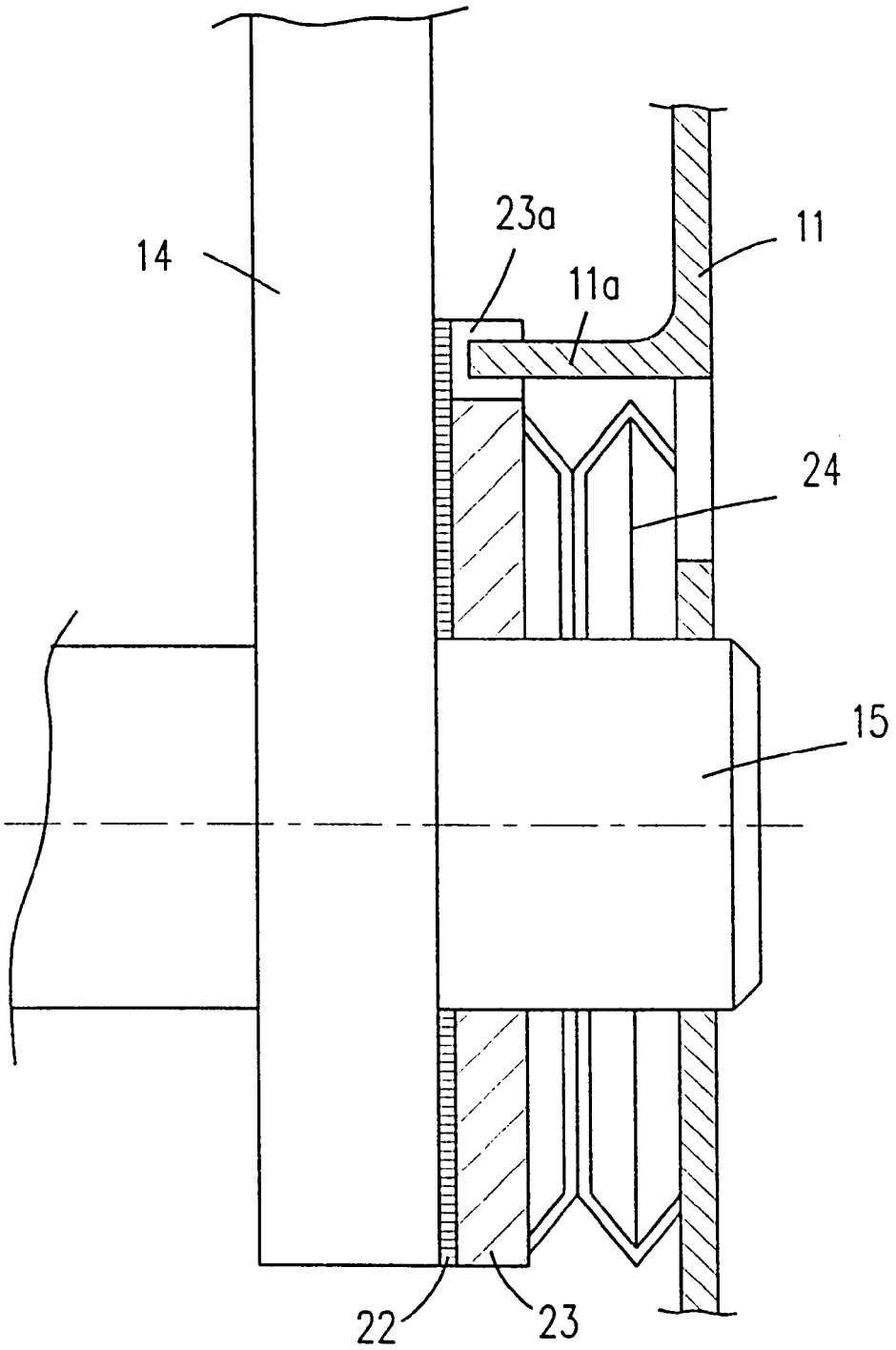
FIG. 6 is a diagrammatic cross-sectional view of an alternative embodiment.

In the embodiment of FIG. 6, the brake disc 23 is fixedly connected to the support plate 11 of the housing by means of a catch 11*a* and is pressed with its brake lining 22 against the lever 14 by the cup springs 24. In all other respects, the operation is the same as in the embodiment shown in FIGS. 1A to 1C and FIG. 5.

Figure 7:
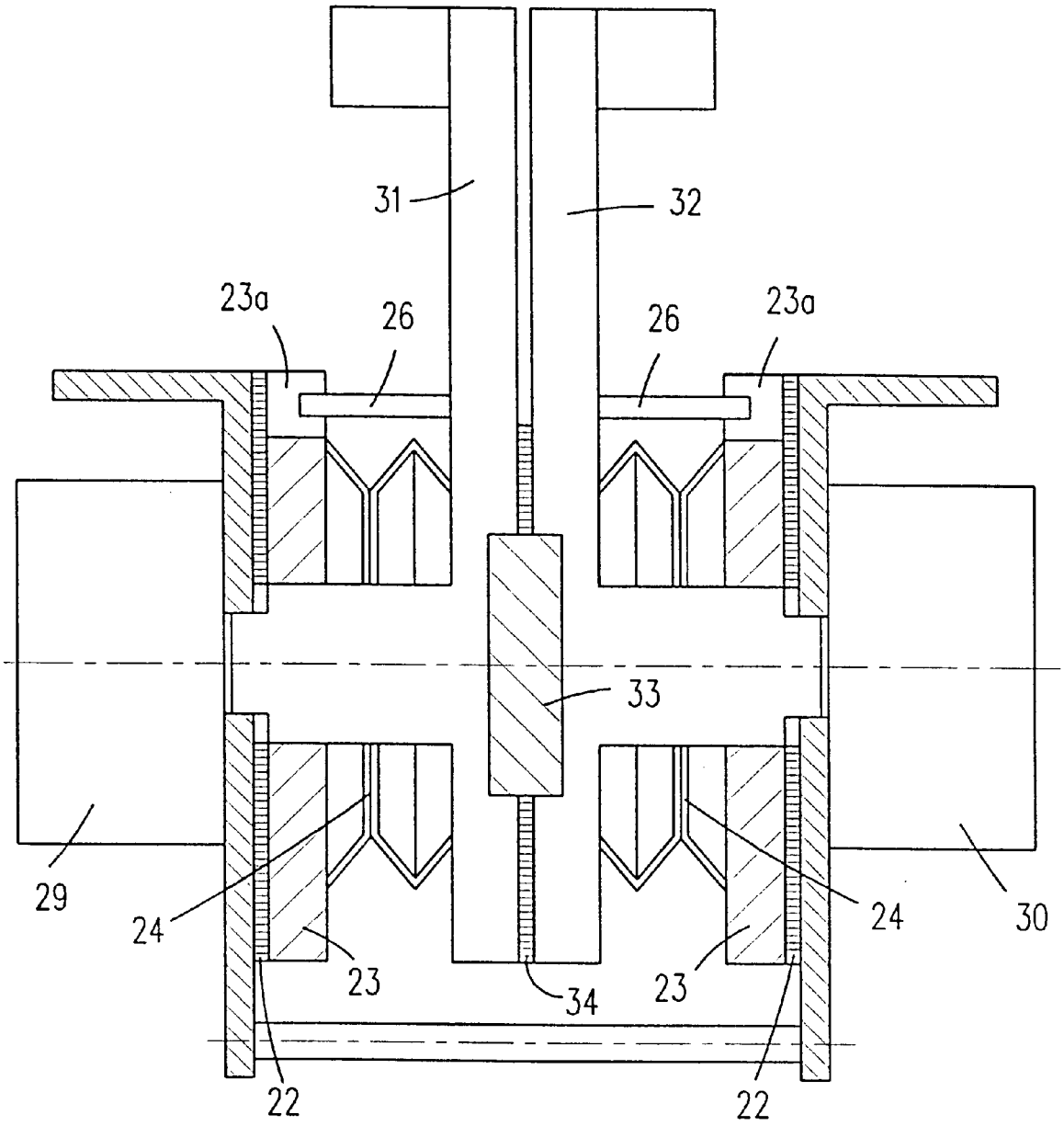
FIGS. 7 and 8 are diagrammatic cross-sectional views of two different embodiments providing for the operation of two potentiometers each time with two levers.

In the embodiment of FIG. 7, two potentiometers 29, 30 are operated by means of two levers 31, 32 which are rotatably coupled to one another via a centering piece 33. Between the two levers 31, 32 there is an additional brake lining 34, so that the two levers 31, 32 can be operated either individually or jointly. In all other respects, the operation is the same as in the embodiments mentioned above.

Figure 8:
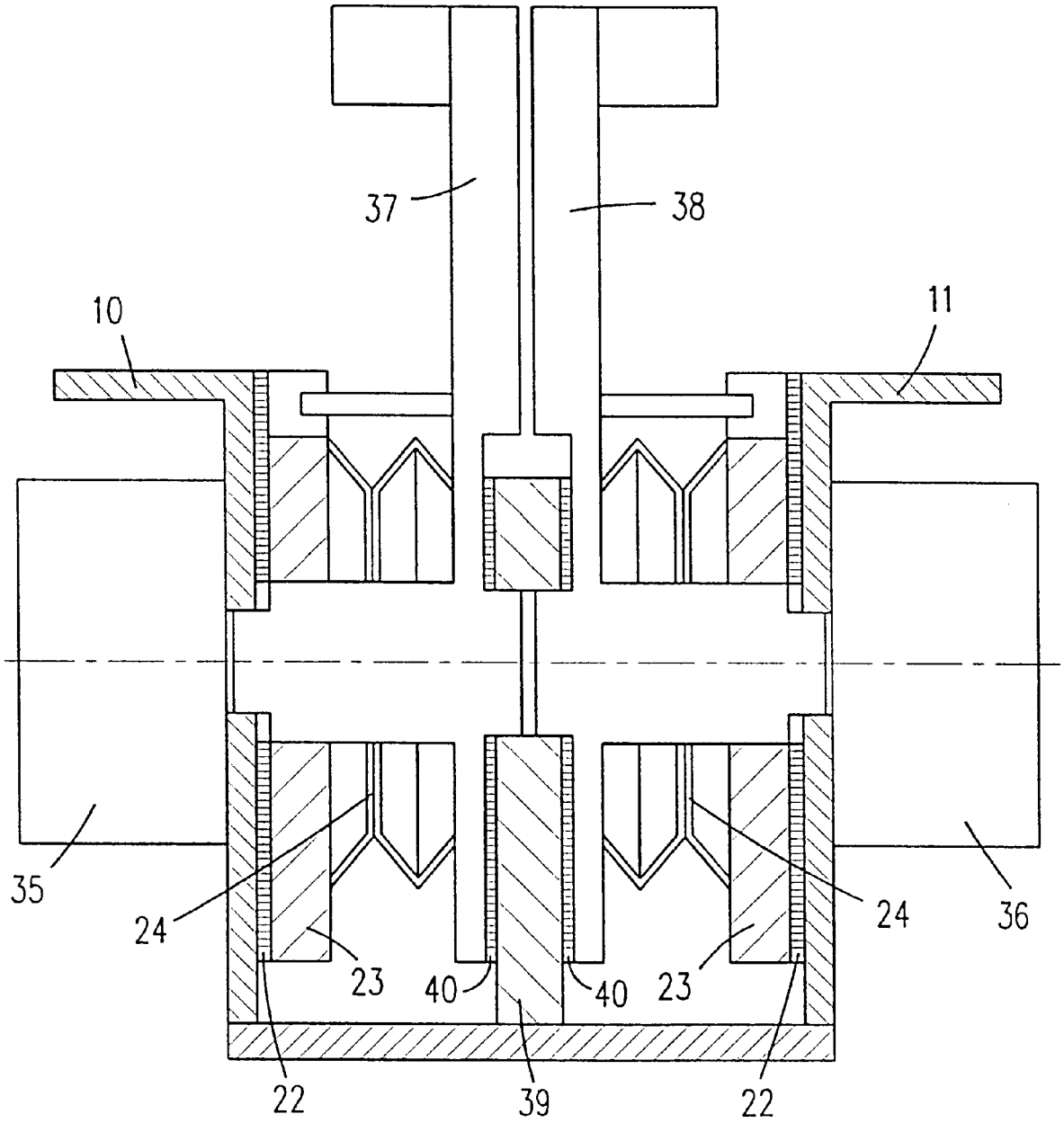

In the embodiment of FIG. 8, two potentiometers 35, 36 are again operated by means of two levers 37, 38, but here each lever 37, 38 is journaled at one side in the relevant support plate 10, 11 and at the other side in a central frame portion 39 which is fixedly connected to the support plates 10, 11. Here the two levers 37, 38 can be operated independently of one another, i.e. they are uncoupled from one another. Brake discs 23 are again provided in this embodiment, pressed with their brake linings 22 against the support plates 10, 11 by the cup springs 24. Additional brake linings 40 may again be arranged between the respective levers 37, 38 and the central frame portion 39 also in this embodiment.

I claim:

1. An adjustment member for at least one device provided with a rotation shaft, said member comprising at least one lever which is fixed to a shaft, which shaft is adapted to be connected to the rotation shaft of the device in a mechanically non-positive manner, and friction means acting under spring force, characterized in that the shaft of the lever is journaled for rotation on both sides, in two support plates which are rigidly connected to one another, the friction means comprises at least one brake disc arranged on the shaft of the lever between the lever and at least one of the support plates, and the spring force is active transversely to the operational direction of the lever.

2. An adjustment member as claimed in claim 1, wherein the brake disc is provided with a brake lining, which disc is rotationally fixedly connected to the lever and is pressed with its brake lining against the adjoining support plate by resilient means.

3. An adjustment member as claimed in claim 2, characterized in that the brake disc and the lever are fixedly interconnected by means of a pin which is fixedly mounted in the lever and which enters a recess or bore which is situated radially on the outside of the brake disc.

4. An adjustment member as claimed in claim 2, characterized in that a brake disc with associated resilient means is arranged on each side of the lever.

5. An adjustment member as claimed in claim 1, wherein the brake disc is provided with a brake lining is at at least one side, which disc is rotationally fixedly connected to the adjoining support plate and is pressed with its brake lining against the lever by resilient means.

6. An adjustment member as claimed in claim 5, characterized in that the brake disc and the adjoining support plate are fixedly interconnected by means of a catch which engages a recess of the brake disc.

7. An adjustment member as claimed in claim 5, characterized in that such a brake disc with associated resilient means is arranged on each side of the lever.

8. An adjustment member as claimed in claim 1, characterized in that two levers each provided on their respective outsides with a brake disc and associated resilient means are rotatably coupled to one another at their free inner sides by means of a centering piece, and in that a brake lining is provided between the mutually facing flat sides of the levers.

9. An adjustment member as claimed in claim 1, characterized in that two levers each provided on the respective outsides with a brake disc and associated resilient means are journaled in a rigid central frame portion at their free inner sides, each with an interposed additional brake lining which central frame portion is rigidly connected to the support plates.

10. An adjustment member as claimed in claim 1 wherein the resilient means comprise cup springs.

11. An adjustment member as claimed in claim 10 further comprising spacer discs inserted between the cup springs and the lever, and/or the central frame portion.

12. A mixing apparatus comprising two support plates which are rigidly connected to one another, a lever fixed to a lever shaft which is journaled in said support plates, said lever having lateral surfaces facing respective said support plates, said lever being rotatable in an operational direction, brake disc on the lever shaft between at least one of said lateral surfaces and at least one of said support plates, spring means acting transversely of said operational direction to load said brake disc against at least one of said at least one lateral surface and said at least one support plate, and a potentiometer fixed to one of said support plates, said potentiometer having a rotation shaft which is connected to said lever shaft in a non-positive manner.

* * * * *